United States Patent [19]

Nishioka

[11] 4,373,541

[45] Feb. 15, 1983

[54] BRISTLE STRUCTURE FOR BRUSHES AND BRUSH ASSEMBLY

[76] Inventor: Gary J. Nishioka, 1268 Hemlock, NW., Salem, Oreg. 97304

[21] Appl. No.: 205,150

[22] Filed: Nov. 10, 1980

Related U.S. Application Data

[63] Continuation-in-part of Ser. No. 64,366, Aug. 7, 1979, abandoned.

[51] Int. Cl.[2] ..... A45D 44/18

[52] U.S. Cl. ..... 132/84 R; 15/159 A

[58] Field of Search ..... 132/84 R; 401/28, 201, 401/267; 206/217; 15/159 A, 167, 188, 105, 111, 145, 104.94; 128/62 A

[56] References Cited

U.S. PATENT DOCUMENTS

| | | | |
|---|---|---|---|
| 564,497 | 7/1896 | Babis | 15/159 A |
| 2,110,371 | 3/1938 | Radford | 15/159 A |
| 2,976,554 | 3/1961 | Hromoko et al. | 401/28 |
| 3,577,839 | 5/1971 | Charvat | 15/159 A |
| 3,671,381 | 6/1969 | Hansen | 15/159 A X |
| 3,696,563 | 10/1972 | Rands | 15/159 A |

*Primary Examiner*—G. E. McNeill

*Attorney, Agent, or Firm*—Eugene M. Eckelman

[57] ABSTRACT

A bristle structure includes abrasive elements located on the shaft of the bristle and providing a cleaning action in addition to the cleaning action provided by the tip ends of the bristles. Such abrasive elements may include scales, serrations, projections ridges, multi-sided designs and other shapes. Multiple bristle structures are combined to form a novel brush assembly.

2 Claims, 14 Drawing Figures

BRISTLE STRUCTURE FOR BRUSHES AND BRUSH ASSEMBLY

CROSS REFERENCE TO RELATED APPLICATIONS

This application is a continuation-in-part of application Ser. No. 64,366 filed Aug. 7, 1979 now abandoned for Improved Toothbrush Assembly.

BACKGROUND OF THE INVENTION

In prior brush structures, the abrasive function is accomplished primarily by the tip ends of the bristles. For example, in toothbrushes, the tip ends do the cleaning, and although the flexing of the bristle under pressure with the tip end serving as the pivot point may cause the shaft portion of the bristles to rub against the teeth and do some cleaning, the design of the tip end is intended to accomplish the primary abrasive action. Thus, the shaft portions of present bristles for brushes are smooth surfaced and the cleaning action by such shaft portions is almost nil.

SUMMARY OF THE INVENTION

According to the present invention and forming a primary objective thereof, a bristle structure is provided which is more effective than bristle structures now in use, such structure employing abrasive means on the bristle shaft portions so that said shaft portions can comprise an abrasive portion either alone or in combination with the tip ends.

It is a further object to provide a brush structure assembly utilizing bristles of the above structure.

To carry out the objectives of the invention, projections such as scales, serrations, ridges, or other designs or combinations of designs are provided on the shaft portion of bristles to form abrasive means. Such abrasive means may also be provided on the tip end of the bristles. By increasing the abrasive area of the bristle, its cleaning ability is greatly increased relative to smooth surfaced bristles. The bristles of the invention can be arranged in tufts in the head of brushes to provide a novel brush structure.

The invention will be better understood and additional objects and advantages will become apparent from the following description taken in connection with the accompanying drawings.

DETAILED DESCRIPTION OF PREFERRED EMBODIMENTS

Figure 1:
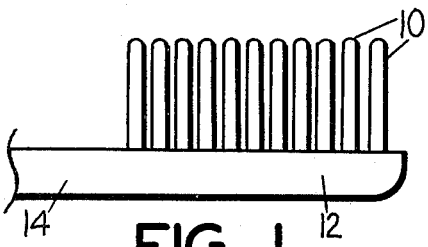
FIG. 1 is a fragmentary side elevational view of a brush which is used to illustrate the concept of the invention.
Figure 2:
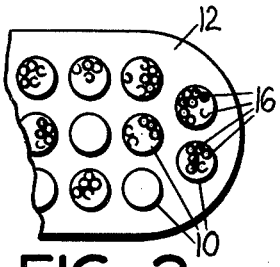
FIG. 2 is an enlarged fragmentary top plan view of the brush of FIG. 1.
Figure 3:
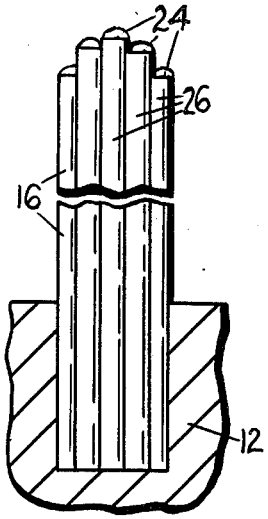
FIG. 3 is a sectional view of a single tuft of bristles that are embedded in a head portion of a brush.

With particular reference to the drawings, and first to FIGS. 1–3, a toothbrush is shown to illustrate the use of bristle structure of the present invention. Although the bristle and brush construction herein illustrated are in association with a toothbrush and have special application to such a brush, it is to be understood that the concept may be used with almost any type of brush and is not to be limited to use with toothbrushes. The bristles may be mounted in tufts 10 embedded in a head or base portion 12, such head portion being operatively associated with a suitable handle 14 operated by hand or power means. The numeral 16 in FIG. 3 represents single bristles in a tift 10, the tufts being suitably secured in the head portion 12 by attachment of the base end of the bristles therein. The numeral 24 designates the tip ends and the numeral 26 designates the shaft portion of the bristles.

Figure 4:
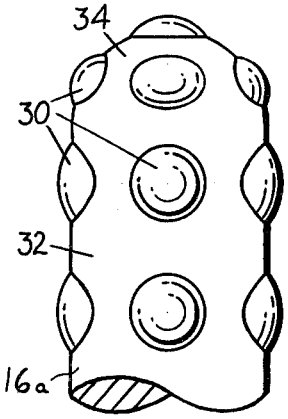
FIGS. 4, 5 and 6 are fragmentary side elevational views of different forms of bristle embodying the concept of the invention.

FIG. 4 shows a first bristle form of the invention. In this form of the invention, a bristle 16*a* has rounded surface projections 30 with their defining edges being circular and with the circular curvature leading into the surface of the shaft portion. These projections are shown as being symmetrically arranged on the shaft portion 32 of the bristle. The projections may also be provided on the tip end 34 of the bristle.

Figure 5:
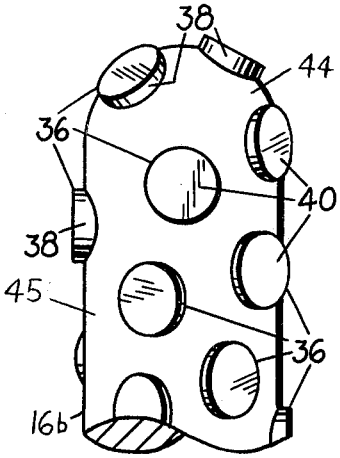

FIG. 5 shows a bristle 16*b* having a slightly modified type of projection 36 from that of FIG. 4, namely, such projections have a defining wall 38 that leads outwardly from the surface of shaft portion 45 and terminates in a flat top 40. Again, in this assembly, the projections 36 can be disposed on the tip end 44 as well as on the shaft portion 45. FIG. 5 illustrates that the projections need not be symmetrically arranged on the shaft but may be randomly placed.

Figure 6:
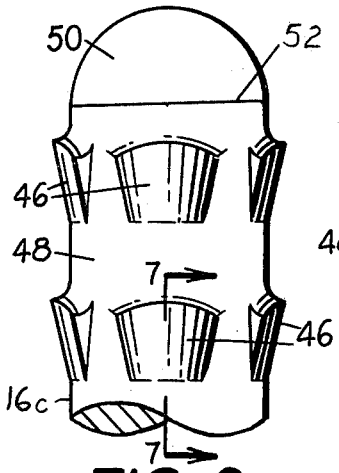
Figure 7:
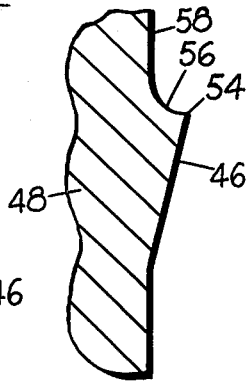
FIG. 7 is an enlarged fragmentary sectional view taken on the line 7—7 of FIG. 6.

FIGS. 6 and 7 show another form of bristle 16*c* wherein such bristle can be provided with scale-like projections 46 on the surface of shaft portion 48. In this example, the concept is illustrated wherein the scales do not continue onto the tip end 50 but stop at the boundary 52 between the shaft portion and tip end which demarcates the perimeter of the tip end. Thus, it is important to note that the abrasive means may or may not continue onto the surface of the tip end depending upon the requirements of the bristle. The portion 56, FIG. 7, demarcating the transition zone from an adjacent shaft surface 58 to the abrading edge or component 54 is designed to prevent accumulation of debris. The scale designed to accomplish the desired function can take on varying forms. Furthermore the number and arrangement of scales, or other abrasive means of the invention, may vary.

Figure 8:
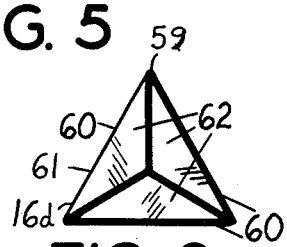
FIG. 8 is a top plan view of a further form of the invention.
Figure 9:
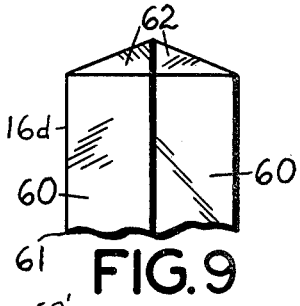
FIG. 9 is a fragmentary side elevational view of the embodiment of FIG. 8.

FIGS. 8 and 9 show a form 16*d* of the invention wherein the abrasive means is achieved by edges 59 between multiple sides 60 on the shaft portion 61. Edges 59 comprise the cutting edge for the abrasive action. As the sides of the shaft reach the tip end they continue on to the tip end surface 62 retaining the one to one design between the shaft and tip end. It is important to note that the number of sides may vary. An example of such modification of the number of sides 60' is shown in FIG.

14 wherein the shaft portion 61′ as well as the tip end surface 62′ possess many sides such as 20 for example.

Figure 10:
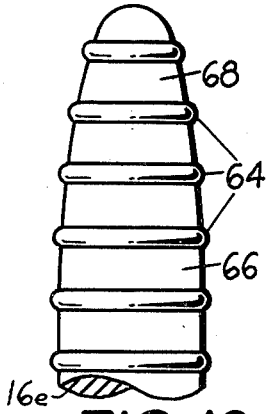
FIGS. 10, 11 and 12 are fragmentary side elevational views of still further forms of the invention.
Figure 11:
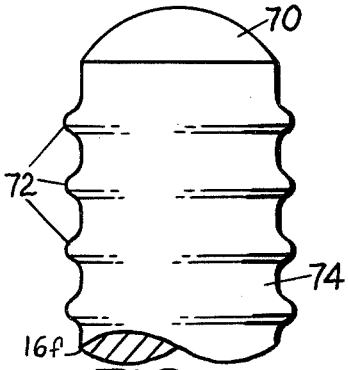

FIG. 10 shows another form 16*e* of the invention, such assembly having annular ridges or serrations 64 arranged in a circumferential manner around the bristle shaft portion 66 and on or closely adjacent to the conical tip end 68. FIG. 11 is somewhat similar to FIG. 10 except that the ridge design in this form 16*f* terminates short of the tip end 70 and the tip end is spherical. In FIG. 10, the circumferential defining edges of the ridges meet abruptly with the surface of the shaft portion whereas in FIG. 11 such ridges are blended in with curved defining areas. Both embodiments of FIGS. 10 and 11 possess substantially the same essential features of this form of the invention but may vary slightly in their abrasive application.

Figure 13:
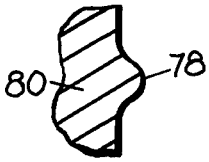
FIG. 13 is an enlarged fragmentary sectional view taken on the line 13—13 of FIG. 12.
Figure 12:
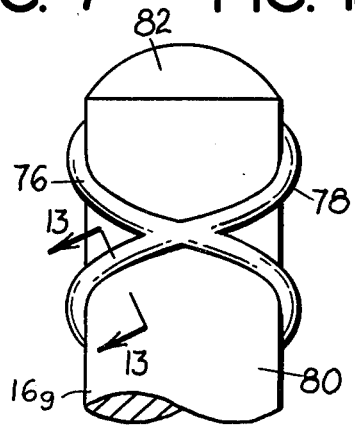
Figure 14:
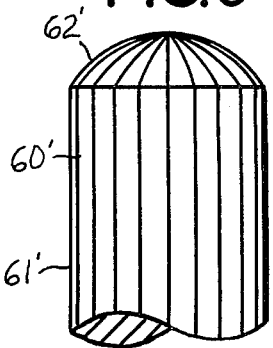
FIG. 14 is a fragmentary side elevational view of yet another form of the invention.

FIGS. 12 and 13 show a form 16*g* having an extension of the ridge design, namely, two ridges 76 and 78 extend around the shaft portion 80 in opposite spiraled directions. In this example the two ridges do not continue on to the tip end 82 but of course may do so if desired. Furthermore the number and exact arrangement of the ridges may also vary.

According to all the embodiments of the present invention, and as apparent in FIGS. 1 and 3, the bristles are all sufficiently rigid to maintain themselves normally in free-standing relation on the head portion. Such bristles are sufficiently flexible, however, to bend during brushing motions whereby to allow abrasive functioning of the tip ends of the bristles as well as to allow abrasive functioning of the abrasive means on the shaft portions of the bristles. The increased abrasive qualities of a bristle shaft portion of irregular surface shape over smooth cylindrical shaped shafts of today's typical brushes results in a more effective cleansing. This cleansing ability may be further enhanced if the abrasive means or alterations are present on the tip end. In addition, it is important to note that the abrasive means may cover the bristle shaft only, the tip end only, or both. It is also within the concept of the invention to mold a bristle with abrasive particles therein so that the abrasive function will be maintained even though the shaft surface of the bristle, as well as the tip end, may be reduced because of wear.

It is to be understood that the forms of my invention herein shown and described are to be taken as preferred examples of the same and that various other changes in the shape, size number, and arrangement of parts may be resorted to without departing from the spirit of my invention or the scope of the subjoined claims.

Having thus described my invention, I claim:

1. A brush structure comprising (a) a head portion, (b) and multiple bristles mounted on said head portion, (c) said bristles each having a base end attached to said head portion, (d) said bristles also each having a shaft portion projecting from said base end and terminating in a tip end, (e) said bristles being arranged in multiple tufts on said head portion with each of said tufts comprising multiple bristles, (f) at least some of said bristles having multiple longitudinally extending flat sides joined with each other by cutting edges, (g) said flat sides and said cutting edges of said bristles extending in uninterrupted relation along the full length of said bristles from said base end to said tip end, (h) said cutting edges being substantially equally spaced apart along the full length of said bristles, (i) said bristles being sufficiently rigid to maintain themselves normally in free-standing relation on said head portion but being sufficiently flexible to bend during brushing motions whereby to allow abrasive functioning of the tip ends of the bristles as well as to allow abrasive functioning of said cutting edges along the shaft portions of said bristles in said tufts.

2. The bristle structure of claim 1 wherein at least some of said bristles comprise three longitudinally extending flat sides joining with each other by three cutting edges in a triangular shape, said cutting edges being substantially equally spaced apart, said three flat sides and said three cutting edges extending in said uninterrupted relation along the full length of said bristles so that said bristles are triangular in shape along their entire length.

* * * * *